US008496188B2

(12) United States Patent
Linton et al.

(10) Patent No.: US 8,496,188 B2
(45) Date of Patent: Jul. 30, 2013

(54) PRESSURE WASHER DEVICE EMPLOYING A COOL BYPASS

(75) Inventors: Paul W. Linton, Gresham, OR (US); Derek Knight, Vancouver, WA (US)

(73) Assignee: Karcher North America, Inc., Englewood, CO (US)

( * ) Notice: Subject to any disclaimer, the term of this patent is extended or adjusted under 35 U.S.C. 154(b) by 575 days.

(21) Appl. No.: 12/821,954

(22) Filed: Jun. 23, 2010

(65) Prior Publication Data

US 2011/0315787 A1 Dec. 29, 2011

(51) Int. Cl.

| | |
|---|---|
| ***B05B 9/04*** | (2006.01) |
| ***B05B 9/01*** | (2006.01) |
| ***B05B 9/00*** | (2006.01) |
| ***B05B 7/30*** | (2006.01) |
| ***E03B 7/07*** | (2006.01) |

(52) U.S. Cl.

USPC ..... 239/124; 239/126; 239/127; 239/128; 239/318; 137/563

(58) Field of Classification Search

USPC ..... 239/124, 126, 127, 128, 310, 318, 239/332, 407, 526, 532, 569, 575; 137/563

See application file for complete search history.

(56) References Cited

U.S. PATENT DOCUMENTS

| | | | | |
|---|---|---|---|---|
| 3,628,727 | A * | 12/1971 | Gjerde | 239/124 |
| 3,756,466 | A * | 9/1973 | Haase | 222/63 |
| 3,760,982 | A * | 9/1973 | Haase | 222/63 |
| 3,829,024 | A * | 8/1974 | Heden | 239/310 |
| 4,306,581 | A * | 12/1981 | Alandt | 137/93 |
| 4,435,127 | A * | 3/1984 | Kranzle et al. | 417/26 |
| 5,035,580 | A * | 7/1991 | Simonette | 417/34 |
| 5,230,471 | A | 7/1993 | Berfield | |
| 5,259,556 | A | 11/1993 | Paige et al. | |
| 5,409,032 | A | 4/1995 | Berfield | |
| 5,979,788 | A | 11/1999 | Rancourt et al. | |
| 2005/0191183 | A1 * | 9/2005 | Kawakami et al. | 417/34 |
| 2007/0267063 | A1 | 11/2007 | Davis | |
| 2010/0006668 | A1 * | 1/2010 | Alexander et al. | 239/129 |
| 2011/0036418 | A1 * | 2/2011 | Hendy | 137/335 |

* cited by examiner

*Primary Examiner* — Darren W Gorman
(74) *Attorney, Agent, or Firm* — Sheridan Ross P.C.

(57) ABSTRACT

A pressure washer device is provided that employs an unloader bypass valve that directs a selective amount of fluid via a small diameter bypass line back to a water storage tank. The small amount of fluid allows for the pump to remain working and introduces cooler water into a bypass circuit, thereby allowing the thermal relief valve to be omitted. The diameter of the bypass line is of such a diameter to prevent siphonage of the detergent associated with the pressure washer system into the water storage tank as well.

7 Claims, 3 Drawing Sheets

PRESSURE WASHER DEVICE EMPLOYING A COOL BYPASS

FIELD OF THE INVENTION

Embodiments of the present invention are generally related to a pressure washer device having a spray gun for directing pressurized fluid to a surface to be cleaned. The system employs a bypass line for directing fluid from an unloader valve to a water supply tank when a trigger of the spray gun is not depressed. The contemplated bypass line diverts only a small portion of the water to the water supply tank, which prevents unwanted siphoning of cleaning solution from a detergent container to the water supply tank. The contemplated bypass system also introduces cooler water from the water supply tank to the system pump and related components, which prevents overheating of the pressure washer device when the spray gun is not activated.

BACKGROUND OF THE INVENTION

Pressure washer devices are used to provide high-pressure, heated fluid to a surface to be cleaned. Such high-pressure fluid can include heated water, or a cleaning solution comprised of a mixture of water and detergent, soap, or other chemicals. The high pressure fluid is delivered to a surface or article to be cleaned by a spray gun that typically employs a user-controlled trigger. As is further understood by those skilled in the art, a pump is typically used to continuously pressurize the fluid in the pressure washer device. Pressure washer devices commonly utilize positive displacement pumps that continuously pump fluid through the system, whether the trigger or other mechanism of the spray gun is activated or deactivated. The flow of liquid through the system also typically functions to cool system components, such as the pump. On occasion, such as when the trigger mechanism is not activated, fluid is not allowed to exit the device, even though the device may be in operation. In this condition, the device has a tendency to overheat the cleaning fluid and/or develop unacceptably high system pressures. To avoid those conditions, devices of the prior art employ a bypass system and/or an automatic pump shut down system. However, these systems do not always prevent overheating and often result in unwanted system shut downs. It is thus desirable to provide a pressure washer device that can continuously pump liquid without adversely affecting the operation of or causing damage to the pressure washer device when the trigger of the spray gun assembly is deactivated.

With reference to FIG. 1, pressure washer devices 2 of the prior art typically utilize a positive displacement pump 6 and a power source 10, such as an internal combustion engine, to heat and move fluid through the device 2. Pump 6 is typically interconnected to an inlet conduit 14 and an outlet conduit 18 and transfers the incoming fluid from the inlet conduit 14 to the outlet conduit 18. The outlet conduit 18 is usually connected to a spray gun 22, which has a trigger 94 or other mechanism that when activated, allows pressurized fluid to exit the wand 86 at nozzle 90.

A water supply tank 30 holds the incoming fluid, typically water, and is interconnected to a supply conduit 32. An inlet filter 54 is often located downstream of the water supply tank 30 to remove contamination and debris from fluid pumped out of the water storage tank 30. Additionally, pressure washer 2 accommodates a cleaning solution container 62 or tank that contains a cleaning solution that may be mixed with water supplied by fluid supply tank 30. The cleaning solution may be detergent, soap, or other chemicals to be mixed, in inlet conduit 14, with fluid stored in tank 30. A metering valve 66 is typically placed near or downstream of the cleaning solution container 62 to control the amount of cleaning solution that is mixed with the fluid.

In operation, pumps of pressure washers typically operate continuously, whether the trigger of the spray gun is activated or deactivated, which causes excess pressure to accumulate in the pump 6, pump inlet conduit 14, the pump outlet conduit 18, and associated components of the pressure washer device when the trigger of the spray gun assembly is not activated. To address the accumulation of excess pressure, an unloader bypass valve 74 is typically employed that re-circulates fluid to the pump via a bypass hose 78 that is interconnected to the pump inlet conduit 14 with a three-opening tee fitting 50. As will be appreciated by one of skill in the art, the temperature of the re-circulating fluid will eventually rise (e.g., reach the boiling point of the fluid in about 20 minutes), which can damage the pressure washer components. The excess temperature is typically removed by a thermal relief valve 70. That is, when the temperature of the fluid in the bypass circuit reaches a predetermined level, the thermal relief valve is opened to dispel the heated water, which wastes water/detergent. It is important to note that detergent is not siphoned from the detergent container 62 to the pump inlet conduit 14 when in a bypass mode, as the pressure in the pump inlet conduit 14 is not reduced.

FIG. 2 shows another prior art pressure washer device having similar components of that described above. This device, however, does not generally employ a thermal relief valve. Here, when the trigger 94 of the spray gun 22 is not depressed, the unloader bypass valve 74 directs fluid from the pump outlet conduit 18 to the bypass hose. The bypass hose directs fluid directly to the water supply tank 30. To complete the bypass circuit, fluid is drawn from the water supply tank 30 into the pump inlet conduit 14 and into the pump 6. The system has a drawback of creating a pressure drop associated with depositing water directly into the water supply tank 30 where the water being pulled from the water storage tank 30 by the pump 6 via the pump inlet conduit 14 has a lower pressure which causes detergent to be drawn into the pump inlet conduit 14 from the detergent container 62. As one skilled in the art will appreciate, this system wastes detergent as eventually the fluid in the water supply tank will become saturated with detergent. When the spray gun 22 is actuated, the fluid being deposited thereby will have an often undesirable concentration of detergent.

To address these problems, a number of pressure washers have utilized an unloader bypass valve 74 that is opened when excess pressure accumulates in the pressure washing device. U.S. Pat. No. 5,230,471 to Berfield is such a device, which is incorporated by reference herein, that utilizes a bypass system comprising a valve that regulates the build up of pressure when a spray nozzle is closed. More specifically, fluid is normally directed through an outlet conduit and discharged through the spray nozzle. When the spray nozzle is closed, liquid is continuously pumped at the same pressure level. The build up of pressure is relieved by the valve which directs fluid to flow from the outlet conduit to a bypass conduit 78 and ultimately to the inlet conduit 14 via tee fitting 50. However, Berfield does not address the problem of dangerously high fluid temperature caused by continuous operation of the pump. Though the fluid is allowed to recirculate, no cooler incoming fluid is introduced because the bypass conduit merely redirects the fluid downstream of the fluid tank 30 and thus into pump inlet conduit 14 and towards the pump 6. As will be understood by skilled artisans, this design may cause pump components to overheat, causing the damage to the device or the device to unwontedly shut down.

U.S. Pat. No. 5,979,788 to Rancourt, et al. discloses a further improvement to regulate the pressure and to prevent rapid overheating of a pressure washer system and is incorporated into this disclosure by reference. Rancourt also utilizes a bypass port to recirculate liquid pumped through the pressure washer device when the spray gun or other mechanism is not in use. In particular, when the spray gun is not in use and the pump is continuously operating, fluid flows into an inlet port and through an unloader valve, which directs the fluid out a bypass port. If the temperature of the recirculating fluid exceeds a maximum threshold level, the thermal relief valve opens and discharges the overheated fluid from the system. A separate pressure relief valve is also included to accommodate excess pressure levels in the recirculated fluid. Thus, if pressure levels exceed a maximum threshold level, the pressure relief valve will also open and discharge water from the system. While Rancourt does not depend on a predetermined level of excess pressure to redirect fluid through the bypass port, Rancourt wastes a substantial amount of fluid through the use of thermal relief and pressure relief valves. The activation of the thermal relief valve and the pressure relief valve can also require additional time and thus costs to cleaning tasks due to periods of inoperability of the pressure system that occur when the valves are active. Rancourt also requires the use of numerous additional components to achieve its safety features, increasing manufacturing costs of the overall device substantially.

Furthermore, the prior art pressure washer devices of Berfield or Rancourt do not prevent the siphoning effect alluded to above. Specifically, when a pressure washer device is in bypass mode, i.e. the trigger of the spray gun assembly is deactivated and the pump continues to operate to move fluid through the device, the prior art pressure washer devices often experience a siphoning effect. More specifically, the unloader valve and associated bypass conduit of the prior art direct cleaning solution at such a volume and flow rate that additional detergent is often pulled from the detergent container. When the trigger is depressed, the detergent laden fluid is expelled. As one of skill in the art will appreciate, this undesirable effect wastes detergent and subjects the item being cleaned to excess detergent, solvent, etc., which may be destructive to the item.

Accordingly, there is a long felt need for a pressure washer device with a bypass system that can re-circulate fluid to the water storage tank that also prevents siphoning of cleaning solution into the incoming fluid supply tank. There is also a need for a pressure washer device which recirculates fluid at a lower temperature than currently available to prevent overheating of the pump or other device components when the trigger or other mechanism of the spray gun assembly is not activated.

SUMMARY OF THE INVENTION

It is one aspect of the present invention to provide a pressure washing system that prevents siphoning of cleaning solution into a fluid supply tank when the pressure washer device is in a bypass mode. It is a further aspect of the present invention to provide a pressure washer device with an unloader bypass valve that allows for the introduction of cooler fluid into a bypass fluid circuit to prevent overheating of the pump. These and other advantages are achieved by the device of the present invention.

One embodiment of the present invention includes a primary power source, such as an internal combustion engine, and a pump that displaces fluid within the pressure washer device. An inlet conduit, an incoming fluid supply tank, and an inlet filter are also employed along with a cleaning solution container to store the cleaning solution, detergent, soap, or other chemicals to be mixed with the incoming fluid. A metering valve may also be employed and positioned in close proximity to the cleaning solution container to control the amount of cleaning solution added to the incoming fluid. A high pressure hose is also preferably interconnected between the pump and a spray gun. The spray gun assembly comprises a trigger, wand portion, and a spray tip that selectively controls the fluid exiting the pressure washer.

Embodiments of the present invention also include a bypass system having an unloader bypass valve that directs fluid exiting the pump to the incoming fluid supply tank. The unloader bypass valve is placed between an outlet conduit of the pump and a high pressure hose associated with the spray gun. In operation, when the trigger of the spray gun assembly is activated, the fluid is pumped through the unloader bypass valve and exits the high pressure hose and spray gun. When the trigger of the spray gun assembly is not depressed, the fluid is redirected through the unloader bypass valve to a bypass hose. The bypass hose is interconnected to a fluid inlet line, which pulls water from the water storage tank, a pump inlet conduit and a reduced-diameter bypass conduit that is also associated with the water storage tank. In one embodiment, the reduced-diameter bypass conduit has a diameter of approximately 0.25".

The novel addition of a reduced diameter bypass conduit allows the fluid in the pressure washer device to recirculate when the trigger of the spray gun assembly is not in use, but also prevents the siphonage of cleaning solution into the fluid supply tank because a portion of the fluid is bypassed to the water supply tank. In addition, the reduced diameter bypass conduit deposits into the tank a portion of the heated and bypassed fluid. Approximately that same amount of fluid is thereafter supplied from the tank to the inlet line 14, introducing a cooler fluid from the water supply tank to the bypass fluid circuit. This introduction of cooler fluid helps to ensure that the overall temperature of the recirculated fluid will not increase and cause overheating of the pump or other device components. Thus, a thermal relief valve, commonly employed in such systems, is not required.

It is thus one aspect of the present invention to provide a pressure washer system comprising a water tank, a pump, a pump inlet conduit having a first end associated with a water supply tank and a second end associated with the pump, a pump outlet conduit having a first end associated with the pump and a second end associated with a spray gun, a bypass valve in fluidic communication with the pump outlet conduit, a bypass hose connecting the bypass valve and the pump inlet conduit, a cool bypass conduit connecting the pump inlet conduit with the water storage tank, the cool bypass conduit having a diameter that is less than that of the bypass hose, and wherein when the spray gun is not engaged to allow fluid to exit the device, fluid is directed from the bypass valve to the bypass hose, the cool bypass conduit, and ultimately to the water supply tank.

The Summary of the Invention is neither intended nor should it be construed as being representative of the full extent and scope of the present invention. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description of the Invention and no limitation as to the scope of the present invention is intended by either the inclusion or non-inclusion of elements, components, etc. in this Summary of the Invention. Additional aspects of the present invention will become more readily apparent from the Detail Description, particularly when taken together with the drawings.

BRIEF DESCRIPTION OF THE DRAWINGS

The accompanying drawings, which are incorporated in and constitute a part of the specification, illustrate embodiments of the invention and together with the general description of the invention given above and the detailed description of the drawings given below, serve to explain the principles of these inventions.

Figure 1:
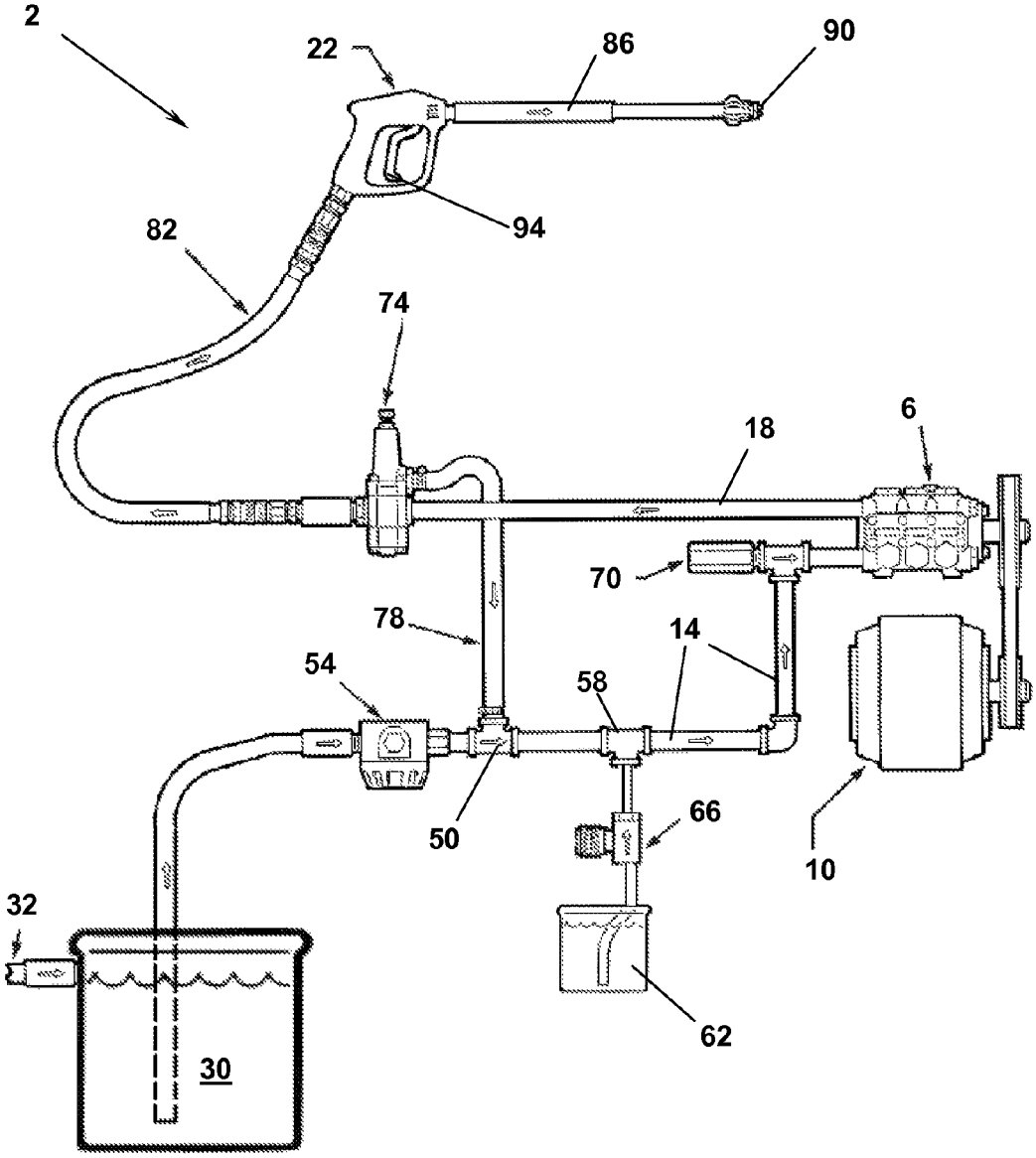
FIG. 1 (PRIOR ART)
FIG. 1 is a schematic of a typical pressure washer hydraulic system of the prior art that employs a thermal relief valve.

To assist in the understanding of one embodiment of the present invention the following list of components and associated numbering found in the drawings is provided herein:

| # | Components |
|---|---|
| 2 | Pressure washer device |
| 6 | Pump |
| 10 | Power source |
| 14 | Pump inlet conduit |
| 18 | Pump outlet conduit |
| 22 | Spray gun |
| 30 | Water supply tank |
| 32 | Supply conduit |
| 50 | Three-opening tee fitting |
| 54 | Inlet filter |
| 58 | Three-opening tee fitting |
| 59 | Four-opening tee fitting |
| 62 | Detergent container |
| 66 | Metering valve |
| 70 | Thermal relief valve |
| 74 | Unloader bypass valve |
| 78 | Bypass hose |
| 80 | Bypass circuit |
| 82 | High pressure hose |
| 86 | Wand |
| 90 | Spray tip |
| 94 | Trigger |
| 98 | Cool bypass conduit |

It should be understood that the drawings are not necessarily to scale. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

Referring now to FIG. 1, a typical pressure washer hydraulic device 2 of the prior art is shown. Here, water from a water source is directed to a fluid storage tank 30 which is interconnected via a pump inlet conduit 14 that is also associated with a tee 50. An inlet filter 54 may be positioned within the pump inlet conduit 14 to ensure that contaminants do not enter into the pressure washing device that may damage or clog the same. A second tee 58 is also associated with the pump inlet conduit 14 and is also associated with a detergent container 62 and a metering valve 66 that selectively feeds (typically via a suctioning effect) a predetermined amount of detergent to the fluid carried in the pump inlet conduit 14.

The pressure washer device system 2 also includes a pump 6 that is powered by a motor 10 by a traditional means, such as a pulley drive system. The pump 6 suctions water from the water fluid supply tank 30, which is mixed with the detergent from the detergent container 62 as described above. A thermal relief valve 70 is associated with the pump inlet conduit 14 and may either release super heated fluid to the environment, turn the pump off if the temperature of the fluid carried in the pump inlet conduit 14 reaches a predetermined temperature, or both.

The pump 6 delivers cleaning solution by way of a pump outlet conduit 18 to an unloader bypass valve 74 that also includes a bypass hose 78 line that directs fluid to the tee 50 and the pump inlet conduit 14. Specifically, the bypass valve 74 is interconnected via a high pressure hose 82 to the spray gun 22 that employs a wand 86 in a spray tip 90. The spray gun 22 includes a trigger 94 that when depressed, allows high pressure fluid to exit wand 86 and the nozzle 90. When the trigger 94 is not depressed, pressure will build up in the device 2 and the unloader bypass valve 74 will activate to direct fluid by way of the water bypass hose 78 to the tee 50 and to the pump inlet conduit 14 to form a circulation circuit.

Figure 2:
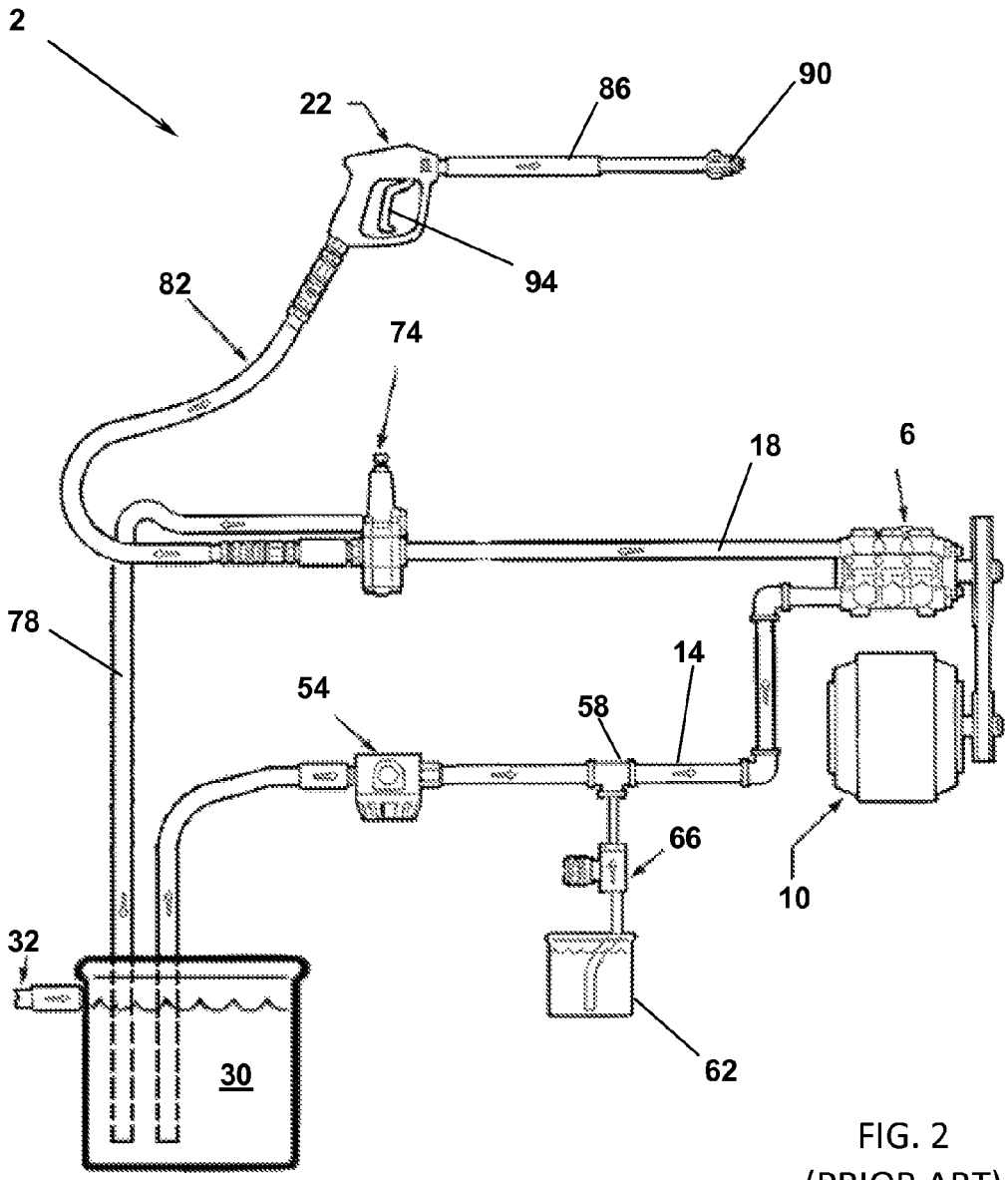
FIG. 2 (PRIOR ART)
FIG. 2 is a schematic of a typical pressure washer hydraulic system of the prior art that employs a bypass to a water storage tank.

Referring now to FIG. 2, a prior art pressure washer device 2 is shown that employs a bypass hose 78 that directs fluid directly to a fluid storage tank 30. In this device, when the trigger 94 of the spray gun 22 is not depressed, fluid from the pump outlet pump conduit 18 is directed by the unloader bypass valve 74 to a bypass hose 78 that dumps fluid directly into the water supply tank 30. The bypass circuit replaces this fluid by drawing fluid from the water supply tank 30 into the pump inlet conduit 14. As one skilled in the art will appreciate, the fluid being drawn from the water supply tank 30 is of a lower pressure than that deposited into the water supply tank 30 by the bypass hose 78. Thus, a vacuum or partial vacuum is created in the pump inlet conduit 14 that tends to pull detergent from the detergent container 62 into the pump inlet conduit 14. By pulling additional detergent into the solution, which is already comprised of a mixture of water and detergent, the detergent in the detergent container 62 will dissipate quicker than desired. Furthermore, the solution expelled by the spray guns 22 when the trigger 64 is depressed, will be of higher concentration than desired.

Figure 3:
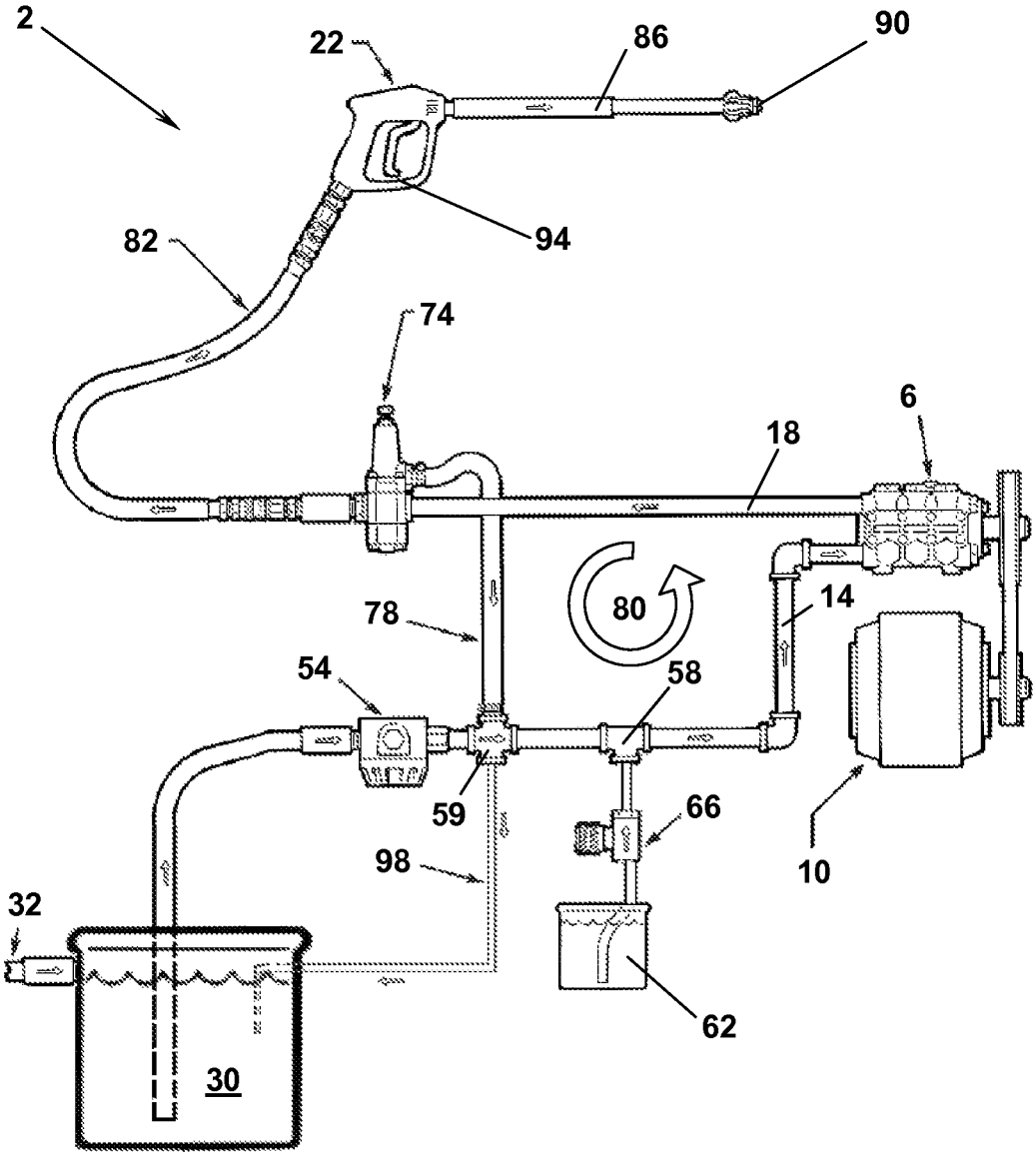
FIG. 3 is a pressure washer hydraulic system of one embodiment of the present invention.

Referring now to FIG. 3, the pressure washer system of one embodiment of the present invention is shown that employs some of the same elements as described above. However, in this embodiment of the present invention, the thermal relief valve is not required as the system includes a cool bypass system associated with the bypass hose 78 that directs a portion of the bypassed fluid to the water storage tank 30. The fluid removed from the bypass circuit 80 (preferably comprised of inlet 14, pump 6, outlet 18, valve 74, bypass hose 78 and tee 59) is replaced by cool water taken from the fluid storage tank 30, mixed with warm fluid in the bypass circuit 80 and circulated through the pump 6. In one embodiment of the present invention, the cool bypass conduit 98 is of a small enough inside diameter as to prevent a significant pressure drop in the bypass circuit 80, thus eliminating the siphon effect that would draw detergent from the detergent container 62 into the pump inlet line 14. For example, the internal diameter of the bypass hose 78 of one embodiment of the present invention is about 0.5 to about 0.75 inches and the internal diameter of the cool bypass conduit is about 0.25 to about 0.375 inches. Preferably, the majority of bypassed fluid is directed back into the pump inlet line 14. Nevertheless, these inventors have found that the introduction of only a minimal amount of cooler water added to the bypass circuit 80 has the effect of lowering the fluid temperature being directed to the pump 6 and bypass valve 74 and to thus achieve one of the benefits of one of the inventions claimed herein.

The bypass valve 74 of one embodiment of the present invention will direct fluid to the bypass hose 78 when the pressure associated with the pump outlet rises above a predetermined set point of the bypass valve 74. To prevent siphoning of detergent from the detergent container 62, the fluid pressure flowing through the bypass hose 78 is not diminished by the addition of the cool bypass line 98 to the point of creating a negative pressure differential that would siphon detergent from the detergent container 62 into the inlet line 14.

While various embodiments of the present invention have been described in detail, it is apparent that modifications and alterations of those embodiments will occur to those skilled in the art. However, it is to be expressly understood that such modifications and alterations are within the scope and spirit of the present invention, as set forth in the following claims. Further, the invention(s) described herein is capable of other embodiments and of being practiced or of being carried out in various ways. In addition, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

What is claimed is:

1. A pressure washer system comprising:

a water tank;

a pump;

a pump inlet conduit having a first end associated with a water supply tank and a second end associated with the pump;

a pump outlet conduit having a first end associated with the pump and a second end associated with a spray gun having a trigger;

a bypass valve in fluidic communication with the pump outlet conduit;

a bypass hose connecting the bypass valve and the pump inlet conduit;

a cool bypass conduit connecting the pump inlet conduit with the water supply tank, the cool bypass conduit having a diameter that is less than that of the bypass hose;

wherein when the spray gun trigger is in a first position fluid is allowed to exit the system and when in a second position fluid is not allowed to exit the system; and wherein when the trigger is in the second position fluid is directed from the bypass valve through the bypass hose, the cool bypass conduit, and to the water supply tank.

2. The system of claim 1 further including a detergent container associated with the pump inlet conduit.

3. The system of claim 2 further including a metering valve that controls the amount of detergent introduced into the pump inlet conduit.

4. The system of claim 1 wherein the pump inlet conduit draws fluid from the water supply tank to replace fluid deposited into the water supply tank from the cool bypass conduit.

5. The system of claim 1 wherein the pump is driven by a motor.

6. The system of claim 1 further comprising a filter associated with the pump inlet conduit.

7. The system of claim 1 wherein the bypass valve will direct fluid to the bypass hose when the pressure in the pump outlet conduit rises above a predetermined value.

* * * * *